US009878456B2

(12) United States Patent
Segler

(10) Patent No.: US 9,878,456 B2
(45) Date of Patent: Jan. 30, 2018

(54) KNIFE

(71) Applicant: MARTOR KG, Solingen (DE)

(72) Inventor: Florian Segler, Solingen (DE)

(73) Assignee: MARTOR KG, Solingen (DE)

( * ) Notice: Subject to any disclaimer, the term of this patent is extended or adjusted under 35 U.S.C. 154(b) by 59 days.

(21) Appl. No.: 14/423,280

(22) PCT Filed: Aug. 29, 2013

(86) PCT No.: PCT/DE2013/000493
§ 371 (c)(1),
(2) Date: Apr. 21, 2015

(87) PCT Pub. No.: WO2014/032646
PCT Pub. Date: Mar. 6, 2014

(65) Prior Publication Data

US 2015/0298324 A1 Oct. 22, 2015

(30) Foreign Application Priority Data

Aug. 30, 2012 (DE) ..... 10 2012 017 127
Apr. 17, 2013 (DE) ..... 10 2013 006 599

(51) Int. Cl.
*B26B 5/00* (2006.01)
*B26B 27/00* (2006.01)
(Continued)

(52) U.S. Cl.
CPC ..... *B26B 5/003* (2013.01); *B26B 1/04* (2013.01); *B26B 1/10* (2013.01); *B26B 5/001* (2013.01); *B26B 27/00* (2013.01)

(58) Field of Classification Search
CPC ..... B26B 5/001; B26B 5/003; B26B 1/02; B26B 1/046; B26B 1/048; B26B 1/08;
(Continued)

(56) References Cited

U.S. PATENT DOCUMENTS 45,196 A * 11/1864 Waters ..... A01G 3/025 30/144
654,204 A * 7/1900 Van Every, Jr. ..... B26B 5/001 30/162
(Continued)

FOREIGN PATENT DOCUMENTS

CA 2500489 A1 * 12/2004 ..... B26B 5/001
DE 2623490 A1 * 12/1977 ..... B26B 1/048
(Continued)

OTHER PUBLICATIONS

English Translation of DE2623490.*

*Primary Examiner* — Jennifer Swinney
(74) *Attorney, Agent, or Firm* — Andrew Wilford

(57) ABSTRACT

The invention relates to a cutting device comprising a housing (14) and a blade carrier (15) to which a blade (16) is secured. Said blade carrier (15) can be moved by means of a lever element (26) of an actuation device at least between a secure position and a cutting position. In the secure position, said blade (16) is accommodated in the housing (14) so that it is inaccessible to the user and in the cutting position, it protrudes out from the housing (14) through a housing opening (32). The invention is characterized in that an extension (12) is arranged between a first handle (24) and the blade carrier (15).

7 Claims, 4 Drawing Sheets

(51) Int. Cl.
*B26B 1/04* (2006.01)
*B26B 1/10* (2006.01)

(58) Field of Classification Search
CPC ..... B26B 1/10; A01G 3/02; A01G 3/0255; A01G 3/025
See application file for complete search history.

(56) References Cited

U.S. PATENT DOCUMENTS 2,184,332 A * 12/1939 Bernay ..... A01G 3/0255 30/243
2,533,962 A * 12/1950 Rowe ..... A01G 3/0255 30/242
2,541,063 A * 2/1951 Hubbard ..... A01G 3/0255 30/124
5,261,163 A * 11/1993 Shearhart ..... A01G 5/00 30/135
8,036,251 B2 10/2011 Amagasaki et al.
8,707,566 B2 4/2014 Rohrbach
8,732,957 B2 * 5/2014 Rohrbach ..... B26B 5/003 30/154
2004/0237312 A1 * 12/2004 Hernandez ..... B26B 5/003 30/162
2010/0088900 A1 * 4/2010 Davis ..... B26B 5/003 30/162
2011/0302787 A1 * 12/2011 Rohrbach ..... B26B 5/003 30/162

FOREIGN PATENT DOCUMENTS

DE 3016724 A1 * 11/1980 ..... A01G 3/0255
DE 4322161 A1 * 1/1995 ..... A01G 3/0255
DE 202008004001 U 9/2008
DE 102008007090 B 5/2009
DE 102012001491 A1 * 8/2013 ..... B26B 5/001

* cited by examiner

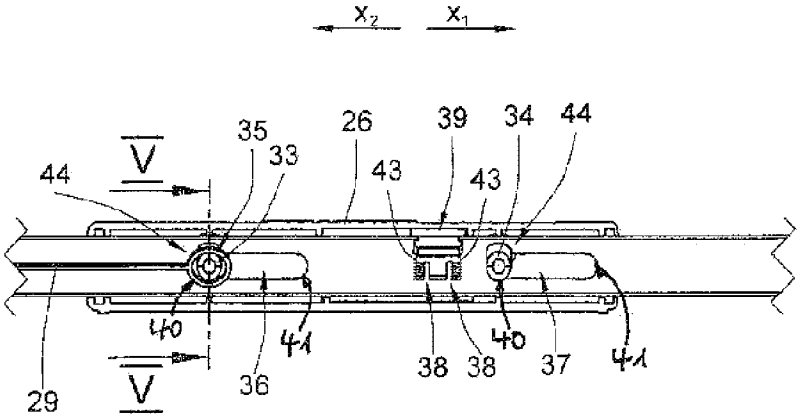
Fig. 5
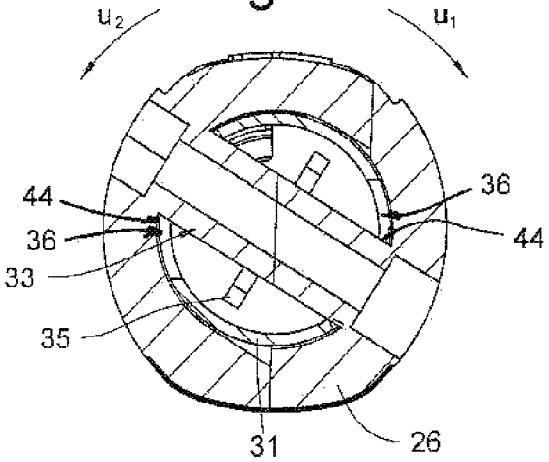
Fig. 4
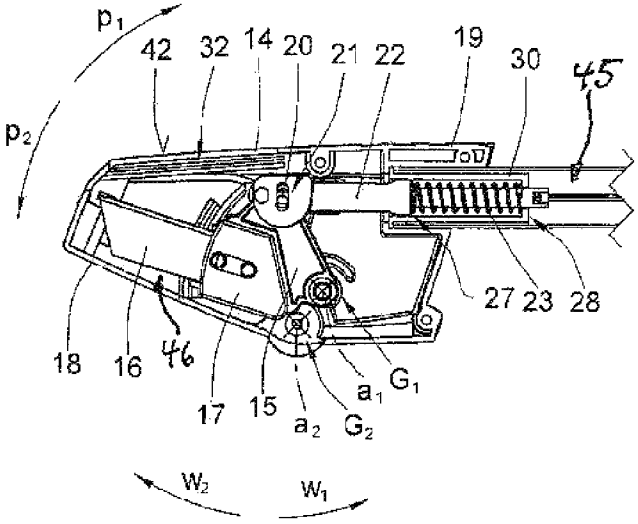

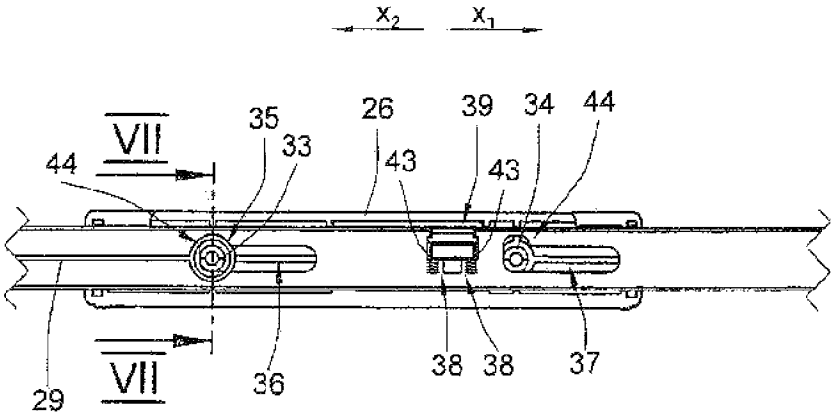
Fig. 7
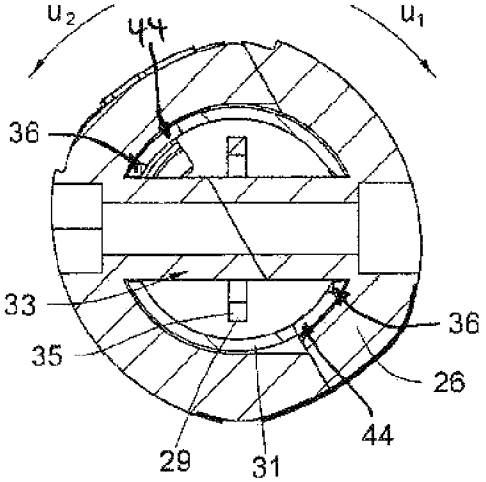
Fig. 6
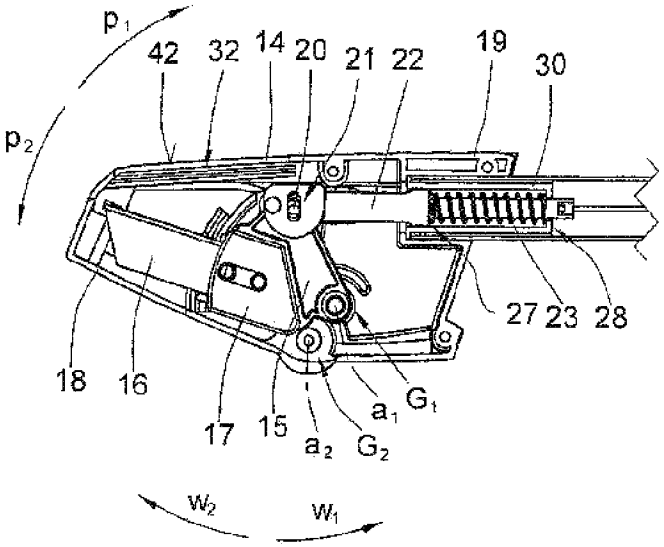

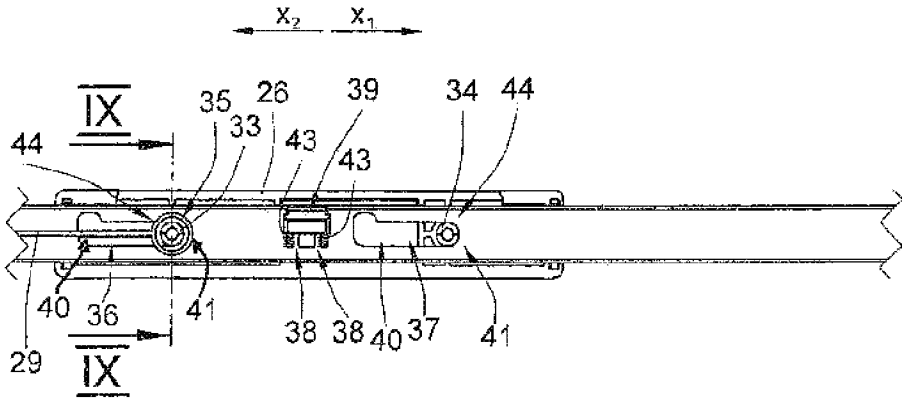
Fig. 9
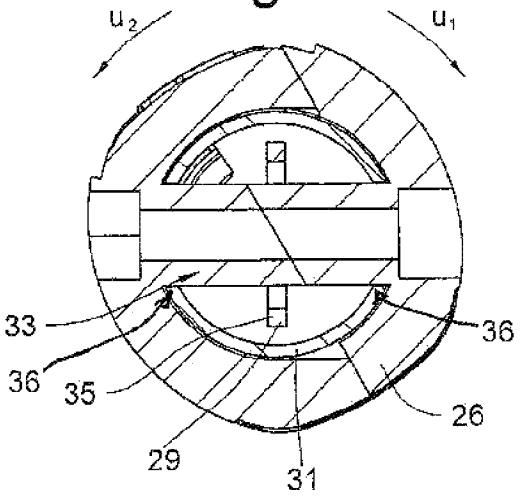
Fig. 8
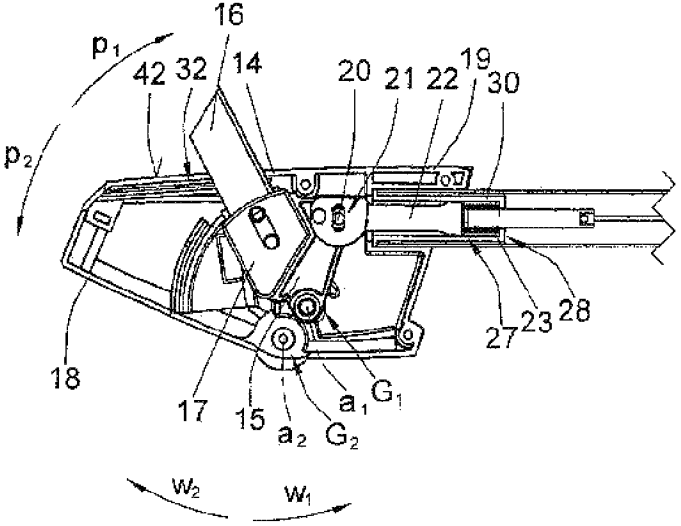

KNIFE

CROSS REFERENCE TO RELATED APPLICATIONS

This application is the US-national stage of PCT application PCT/DE2013/000493 filed 29 Aug. 2013 and claiming the priority of German patent application 102012017127.7 itself filed 30 Aug. 2012 and German patent application 102013006599.2 itself filed 17 Apr. 23.

FIELD OF THE INVENTION

The invention relates to a knife.

BACKGROUND OF THE INVENTION

A utility knife that has a knife housing and a blade carried by a blade support is known from obvious prior use. The blade support can be moved between a safety position where the blade is situated in the housing, inaccessible to the user, and a cutting position where the blade projects out of the housing.

Such a blade was used for cutting bags open, for example, which are hanging from a conveyor and contain bulk material, for example. In this connection, there is the risk that the bag will come loose, fall, and injure the user of the knife.

OBJECT OF THE INVENTION

It is therefore the object to create a knife that guarantees great safety and at the same time is easy to handle. In particular, it was the object of the invention to create a knife that can be used for cutting objects that represent a hazard to the user, for example because of their weight or their composition, when the user is near the material to be cut.

SUMMARY OF THE INVENTION

This object is attained by a knife having a housing and a blade support that is movably mounted in the housing. A blade is carried by the blade support. The blade is for example releasably secured to the blade support. The blade support can be moved between a safety position and a cutting position. In the safety position of the blade support, the blade is disposed completely inside the housing so that the user of the knife cannot be injured by the blade. In the cutting position, the blade projects out of the housing. In this position it extends through a housing opening, for example.

The knife, particularly the blade support, can be moved between the safety position and the cutting position by an actuation mechanism. The actuation mechanism has an operating element and a force-transmitting linkage. The force-transmitting linkage transmits movement of the operating element to the blade support. The operating element therefore serves for actuating the blade support.

An extension, for example, extends between a rear handgrip of the knife and the blade support. The cutting region is at a front end of the extension, for example. The extension extends between the rear handgrip and a knife housing. The operating element is mounted on the extension, for example at a spacing from the cutting region. It forms a front handgrip, for example. The operating element can be on the extension in a central region of the extension, for example. The user can then hold the cutting device with one hand on the rear handgrip and with the other hand on the operating element, for example, and actuate it. In this case, the operating element serves to actuate and guide the knife, for example.

A spacing between the user of the cutting device and the material to be cut can be bridged by the extension, and the blade can be engaged with the material to be cut. Because of the extension, it is therefore possible for the user of the cutting device to stand at a spacing from the material to be cut and operate the knife. If the material to be cut unintentionally comes loose and falls down during the cutting procedure, it cannot injure the user of the cutting device. The knife can even be used, for example, for radioactive or toxic materials to be cut, or for materials to be cut that contain radioactive or toxic substances.

The operating element can be moved relative to the extension between at least a first use position and a second use position, for example. By movement of the operating element from the first use position into the second use position, the blade support can be moved from the safety position into the cutting position, for example. During movement of the blade support into the cutting position, a resiliently elastic element connected with the blade support so as to move with it can be tensioned, for example. The blade support then automatically returns to the safety position when the operating element is released, for example.

The operating element can be moved between the first use position and at least the second use position. Furthermore, the operating element can be moved into at least one locking position, for example. The operating element can be moved between the first use position and the locking position, for example. Alternatively, however, the operating element can also be moved from each use position into a first locking position or into at least a further locking position.

One embodiment is characterized in that the rear handgrip is at the rear end of the extension. A front handgrip is on the extension, for example, spaced forward of the rear handgrip. The operating element is mounted on the front or the rear handgrip, for example.

The operating element or the blade support can be locked by a latch, for example. The latch can be moved between at least one locking position and at least one unlocking position. In the locking position, movement of the blade support into the cutting position is not possible. In this manner, unintentional movement of the blade support from the safety position into the cutting position can be prevented. When the latch is in the unlocking position, movement of the blade support between the safety position and the cutting position is possible. The latch interacts directly or indirectly with the blade support or with the operating element, for example.

For example, the operating element can be moved into at least one locking position. Locking of the operating element takes place by movement of the operating element into the at least one locking position. For example, the operating element can be moved, particularly pivoted, from the first use position into the locking position. The operating element is biased into the locking position by a reset mechanism, for example. The reset mechanism can comprise a spring, for example, that is elastically deformed during movement of the operating element from the locking position into the first use position, for example.

One embodiment of the invention is characterized in that the extension is a rod or a tube. In this case, the operating element can be moved relative to the rod or the tube. The operating element can be mounted on the tube so as to slide on it, for example. Parts of the actuation apparatus can be disposed inside the tube, for example.

The operating element can be moved, for example, by a first movement between the first use position and the locking position, and can be moved by a second movement between the use position and the locking position. The first movement can be a straight-line movement of the operating element, for example. The second movement can be a rotational movement of the operating element, for example. The operating element can be pivoted between the use position and the locking position, for example.

According to one embodiment of the invention, the operating element can be displaced relative to the tube approximately parallel to a center axis of the tube. The operating element can be formed, for example, by a sleeve coaxial with the tube. The sleeve can surround the tube, at least in part.

The operating element can be guided on the tube by a guide, for example, particularly by a motion link guide. For example, the tube has a motion link into which a pin connected with the operating element engages. The motion link has at least one locking region, for example. When the pin engages into the locking region, movement of the operating element between the safety position and the cutting position is not possible.

According to one embodiment, the blade support is biased into the safety position by a reset mechanism. The reset mechanism can interact with the blade support directly or indirectly. For example, the reset mechanism interacts with the operating element or the force-transmitting linkage. In this case, the blade support is automatically moved back into the safety position from the cutting position when the blade support is no longer held in the cutting position by the actuation apparatus or by the cutting force applied to the blade.

The blade support is mounted so as to pivot about an axis, for example. In this case, the safety position and the cutting position are angularly offset positions. Alternatively, the blade support can be moved between the safety position and the cutting position by straight-line movement. According to a further alternative, the blade support can be moved between the safety position and the cutting position by a composite movement. The composite movement has components of a straight-line movement and pivoting, for example.

According to a further embodiment, the blade support is a two-armed lever. A first lever arm forms a seat for the blade, for example, and a second lever arm forms a securing location for the force-transmitting linkage, which is part of the actuation apparatus, for example. In the sense of the invention, lever arm is understood to mean that different securing points are present on the blade support for the blade and for the actuation apparatus. The securing points do not necessarily have to be disposed on an arm. They can be on an arm, for example, or, alternatively, on any form of a pivotable element, such as a circular disk or a freely shaped part, for example.

One embodiment is characterized in that the force-transmitting linkage of the actuation apparatus has a tension cable and/or a chain and/or a rod system. The tension cable, the chain or the rod system is/are indirectly or directly connected with the operating element and with the blade support. In this manner, tension and/or pressure can be transferred between the operating element and the blade support.

BRIEF DESCRIPTION OF THE DRAWING

Further advantages are evident from the illustrated embodiment shown in the figures. Therein:

FIG. 4 is a schematic sectional view along section line IV-IV of FIG. 1, FIG. 5 is a schematic sectional view along section line V-V of FIG. 1V, FIG. 6 is a schematic sectional view along section line VI-VI of FIG. 2, FIG. 7 is a schematic sectional view along section line VII-VII of FIG. 6, FIG. 8, FIG. 6 a schematic sectional view along section line VIII-VIII of FIG. 3, FIG. 9 is a schematic sectional view along section line IX-IX of FIG. 8.

SPECIFIC DESCRIPTION OF THE INVENTION

The knife is referred to generally with 10 in the figures. In the different figures, the same reference symbols refer to the same parts, even when lower-case letters are added or left out.

Figure 1:
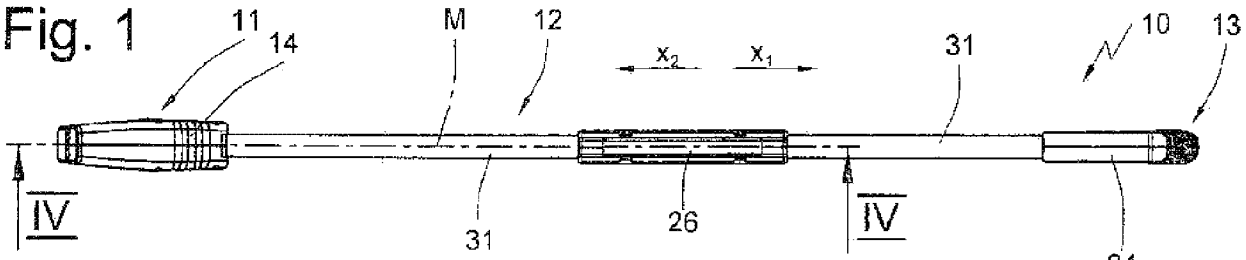
FIG. 1 is a schematic top view of the knife in a safety position where the operating element is in the locking position.

FIG. 1 is a schematic view of the knife. According to FIG. 1, in this illustrated embodiment the knife has an extension 12 that is formed by a tube 31. A housing 14 is secured to an outer end 11 of the extension 12. A rear handgrip 24 is secured to an inner end 13 of the extension 12. Furthermore, a front handgrip/operating element 26 for actuation of the knife 10. The operating element 26 is part of an actuation apparatus.

The handgrip/operating element 26 is a sleeve formed by two half shells. It encloses the tube 31, is coaxial to a center axis M of the tube 31, and can slide on the tube 31.

The knife 10 has a latch for preventing unintentional movement of the blade support 15 from the safety position into the cutting position. In this illustrated embodiment, locking takes place by movement of the operating element 26 into the locking position shown in FIGS. 1, 4, and 5.

FIG. 4 is a section along section line IV-IV of FIG. 1. The blade support 15 is mounted so that it can pivot on the housing 14 about an axis $a_1$. The blade support 15 forms a pivot joint $G_1$ with the housing 14. A blade 16 is secured to the blade support 15 in a seat 17 of the blade support 15. According to FIG. 4, the blade support 15 is in the safety position. The blade support 15 can be pivoted from the safety position, in the direction $p_1$, about the pivot axis $a_1$, into the cutting position shown in FIG. 8. The blade support can be pivoted from the cutting position, in the direction $p_2$, into the safety position.

The housing 14 has a slit-shaped opening 32, through which the blade 16 can project from the housing 14. A part of the wall of the housing 14 is formed by a flap 18 that, together with a base 19 of the housing 14, forms a pivot joint $G_2$ having an axis $a_2$. The flap 18 can be pivoted relative to the base 19 from the closed position shown in FIG. 4 in the direction $w_1$, into an unillustrated open position. From the open position, the flap 18 can be pivoted in the direction $w_2$ into the closed position shown in FIG. 1. An interior 46 of the housing 14 is accessible from the outside in the open position, for example in order to change the blade. In the closed position, the interior 46 of the housing 14 is inaccessible.

The blade support 15 is provided with a pivot pin 20 that engages in an slot 21 of a rod 22. The pivot pin 20 is guided in the slot 21. In this manner, the rod 22 is coupled to the blade support 15. The slot 21 and the pivot pin 20 form a movement converter with which movement of the rod 22 in the directions $x_1$ and $x_2$ can be converted into movement of the blade support 15 in the respective pivot directions $p_1$ and $p_2$.

The rod 22 is provided with a shoulder 27 on which an end of a spring 23 is braced. An opposite end of the spring 23 is braced against the floor 28 of a sleeve 30 secured to the tube 31. The sleeve 30 extends in an interior 45 of the tube 31 coaxial to the center axis M. The rod 22 is biased in the forward direction $x_2$ by the spring 23.

Since the rod 22 is coupled to the blade support 15, the blade support 15 is biased into the safety position by the spring 23.

One end of a tension cable 29 is secured to the rod 22, and its other end forms a loop 35. The loop 35 is traversed by a an anchor pin 33 of the operating element 26. The tension cable 29 extends through the interior 45 of the tube 31. Thus tension can be applied by the operating element 26 to the rod 22 via the tension cable 29.

The tube 31 forms a guide. It has two opposite L-shaped front slots 36 and two opposite L-shaped rear slots 37 formed in the wall of the tube 31. The anchor pin 33 passes through the front slots 36, and a pin 34 of the operating element 26 passes through the rear slots 37. The anchor pin 33 is guided by the slots 36, and the pin 34 is guided by the slots 37. According to FIG. 4, the pins 33 and 34 are in locking regions 44 of the slots 36 and 37 at ends 40 of the respective slots 36 and 37 and running approximately at right angles to the longitudinal axes of the slots 36 and 37.

The operating element 26 can be pivoted from the locking position shown in FIG. 4 in which the pivot pin 33 is in the locking region 44 of the slot 36 and the pin 34 is in the locking region 44 of the slot 37 in the direction $u_2$ into the first use position shown in FIG. 6. The pins 33 and 34 of the operating element 26 are in ends 40 of the respective slots 36 and 37 in the locking position and in the first use position. From the first use position, the operating element 26 can be pivoted in the direction $u_1$ into the locking position shown in FIGS. 1 and 4. Movement in the direction $x_1$ or $x_2$ is not possible in the locking position.

Figure 2:
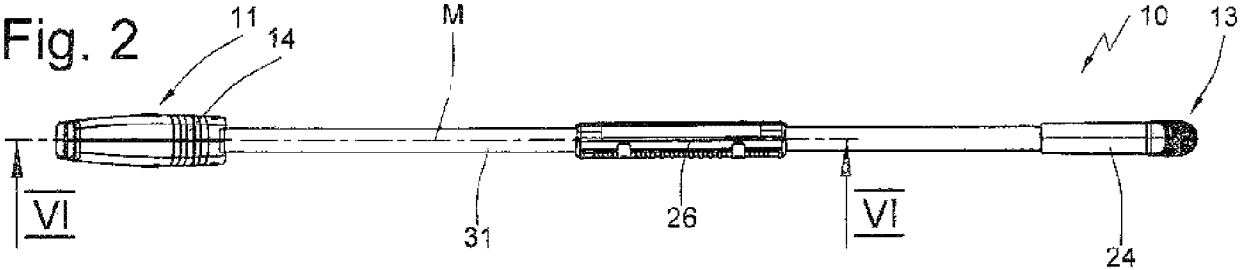
FIG. 2 is a schematic top view of the knife in a safety position where the operating element is in the first use position.
Figure 3:
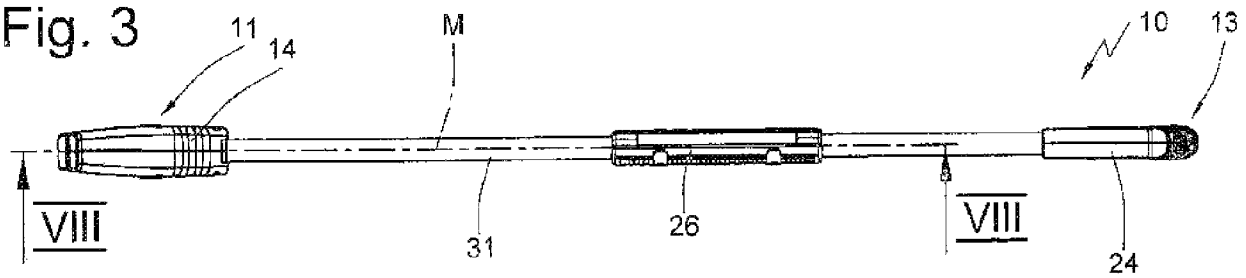
FIG. 3 is a schematic top view of the knife in a cutting position where the operating element is in the second use position.

The operating element 26 can be moved from the first use position parallel to the longitudinal axis M of the tube 31, in the rearward direction $x_1$ into a second use position shown in FIG. 2. The pins 33 and 34 of the operating element 26 are disposed in an end 41 of the respective slots 36 and 37 in the second position. From the second use position, the operating element can be pivoted in the direction $x_2$, into the first use position.

A reset mechanism of the operating element 26 is provided at a hole 39 in the wall of the tube 31. Two pins 38 that project into the hole 39 are formed on the tube 31. The pins 38 serve to anchor an inner end of a spring 43 bearing against a shoulder of the operating element 26 with its outer end. The operating element 26 can be moved relative to the outer end so that spring 43 bears against the operating element 26 in every position. According to an alternative embodiment, the outer end of the spring 43 can also be provided with a slide piece bearing on a shoulder of the operating element 26. In this manner, the operating element is biased in the pivot direction $u_2$ into the locking position.

FIGS. 5, 7, and 9 each show a section through the operating element 26, the tube 31, and the anchor pin 33. FIG. 5 shows the locking position, FIG. 7 shows the first use position, and FIG. 9 shows the second use position of the operating element 26.

The function of the knife will be described below.

In order to carry out a cutting procedure, the operating element 26 is pivoted in the direction $u_2$ from the locking position shown in FIGS. 4 and 5 relative to the tube 31 about the longitudinal axis M into the first use position shown in FIGS. 6 and 7. From the first use position, the operating element 26 can be displaced in the direction $x_1$ into the second use position shown in FIGS. 8 and 9. During movement of the operating element 26 from the first use position into the second use position, the tension cable 29 and the rod 22 are also moved in the direction $x_1$. The spring 23 is loaded by movement of the rod 22 in the direction $x_1$.

The rod 22 furthermore moves the blade support 15 via the pivot pin 20 in the pivot direction $p_1$ into the cutting position shown in FIG. 8. In the cutting position, the blade 16 extends through the opening 32 of the housing 14. The material to be cut can now be severed using the blade 16. During the cutting procedure, an outer surface 42 of the housing 14 forms a contact surface for the material to be cut.

In the cutting position according to FIG. 8, the spring 23 is loaded and biases the rod 22 in the direction $x_2$. As soon as stress on the operating element 26 is relieved, i.e. it is no longer held in the second use position by the user of the cutting tool 10, the rod 22 moves forward in the direction $x_2$ by the spring 23. When this happens, the rod 22 rotates the blade support 15 in the pivot direction $p_2$ from the cutting position of FIG. 8 into the safety position of FIG. 6. During movement of the rod 22 in the direction $x_2$, the operating element 26 is also moved in the direction $x_2$ from the second use position into the first use position by the tension cable 29. Subsequently, the operating element 26 is automatically pivoted in the direction $u_1$ into the locking position by the spring 43.

The invention claimed is:

1. A knife comprising:

a housing extension extending along an axis and having a front end and a rear end;

a blade housing secured on the front end of the extension;

a rear handgrip mounted on the rear end of the extension;

a front handgrip on the housing extension forward of the rear handgrip, one of the handgrips being axially movable; and a blade support pivotal in the housing, carrying a blade, and movable at least between a safety position in which the blade is recessed in the blade housing and a cutting position in which the blade projects through a housing opening out of the blade housing, the one axially moveable handgrip being operatively connected to the blade support for joint movement therewith.

2. The knife according to claim 1, wherein the one handgrip is axially moveable between at least a first position and a second position.

3. The knife according to claim 2, wherein the one axially moveable handgrip is moveable between the first position and the second position by a straight-line movement.

4. The knife according to claim 1, wherein the housing extension is a rod or a tube.

5. The knife according to claim 1, wherein the blade support is a two-armed lever having a first lever arm connected with the blade and a second lever arm connected with the one axially moveable handgrip.

6. The knife according to claim 1, further comprising: a tension cable or a rod system connected between the one axially moveable handgrip and the blade support.

7. The knife according to claim 1, wherein the one axially movable handgrip is movable between one of the first and second positions and a locking position by another straight-line or rotational movement.

* * * * *